US005612984A

United States Patent [19]

Fuller et al.

[11] Patent Number: 5,612,984

[45] Date of Patent: Mar. 18, 1997

[54] SHEET COUNTING

[75] Inventors: Graham D. Fuller, Cranfield; Martin G. Snook, Colchester, both of Great Britain

[73] Assignee: Pelcombe Limited, England

[21] Appl. No.: 569,113

[22] PCT Filed: Jun. 16, 1994

[86] PCT No.: PCT/GB94/01302

§ 371 Date: Dec. 18, 1995

§ 102(e) Date: Dec. 18, 1995

[87] PCT Pub. No.: WO95/00926

PCT Pub. Date: Jan. 5, 1995

[30] Foreign Application Priority Data

Jun. 18, 1993 [GB] United Kingdom ..... 9312614

[51] Int. Cl.[6] ..... G06M 7/00

[52] U.S. Cl. ..... 377/8

[58] Field of Search ..... 377/8

[56] References Cited

FOREIGN PATENT DOCUMENTS 2238411 5/1991 United Kingdom ..... 377/8

095000926 1/1995 WIPO ..... 377/8

*Primary Examiner*—Margaret Rose Wambach

*Attorney, Agent, or Firm*—Andrus, Sceales, Starke & Sawall

[57] ABSTRACT

A rotor (10) for use in a counter to count the number of sheets in a stack has a number of transfer grooves (13), leading generally helically from the upper surface (11) to the lower surface (12) of the rotor (10). Each groove (13) has a number of suction ports (15) communication through internal passageways in the disc to a source of low pressure, to draw the next sheet in a stack to be counted into the transfer groove. The rotor also defines a reject slot (32) and in a finger (23) overlying part of the rotor surface leading into the transfer groove (13), there are further ports (25), to which suction is applied in a timed relationship to rotor rotation. If the rotor should pick-up two overlying sheets, suction through the further ports (25) will separate the two sheets and the upper sheet will be rejected out of the reject slot (32) to be counted on the next count cycle, whilst the lower sheet continues into the transfer groove (13), to be counted normally.

15 Claims, 3 Drawing Sheets

SHEET COUNTING

This invention concerns the counting of sheets, for example of paper, assembled into a stack. In particular, this invention relates to a rotor for counting the number of sheets in a stack by engaging an edge region of the stack and rotating the rotor to separate an edge portion of each sheet in turn from the stack and to transfer the separated edge portion through a transfer groove to the other side of the rotor, there being at least one suction port in the rotor and through which air is drawn in a timed relationship to rotor rotation to assist the separation from the stack of the next sheet edge portion to be counted. Such a rotor will hereinafter be referred to as a "rotor of the kind described".

Sheet counting apparatus including a rotor of the kind described is prone occasionally to give a miscount, especially when the rotor first engages the stack and commences a counting operation. One reason for this is that the sheets in a stack may tend to adhere to each other, especially along an edge of the stack which has been guillotined to cut the sheets to a required size. In such a case, it is possible for two sheets to stick together and for both sheets simultaneously to be lifted into engagement with the rotor by air drawn through the suction port, both sheets then passing through the transfer groove to the other side of the rotor, and giving only a single count.

Another problem associated with sheet counting apparatus including a rotor of the kind described is that it is possible for the counting process not to proceed as quickly and efficiently as possible since a sheet may not properly be lifted to engage the rotor, for guiding into the transfer groove. Again, this may be exacerbated by adjacent sheets in the stack tending to stick together. This problem, and that discussed above, may be minimised by "fanning" the sheets in the stack before attempting to commence a counting operation, but this may not be particularly easy to perform, especially if relatively large sheets are to be counted, or if the stack contains a relatively large number (perhaps several thousand) sheets. On the other hand, if the sheets are relatively small, or only a small number of sheets is to be counted, then their alignment may be spoilt by a fanning operation and in turn this may give rise to mis-counts.

The present invention aims at addressing the above described problems associated with known forms of sheet counting apparatus including a rotor of the kind described, so as to minimise the likelihood of a mis-count, or of no sheet being transferred and counted on a count cycle.

According to one aspect of the present invention, there is provided a rotor of the kind described, wherein the rotor is provided with at least one further port through which air is drawn during rotation of the rotor which further port is arranged on the opposite side of the transfer groove to said suction port, whereby should two adjacent sheet edge portions be simultaneously separated together from the stack and be lifted by said suction port, suction through the further port will lift the edge portion of the second sheet away from the sheet to be counted, to guide said second sheet edge portion away from the transfer groove for counting on a subsequent count cycle.

It will be appreciated that in a rotor of this invention, means are provided to separate two sheets and reject one of those sheets out of the transfer groove of the rotor, in the unlikely event that two sheets had stuck together and been lifted simultaneously from the stack and into the transfer groove by suction at the suction port of the rotor. In this way, the probability of a mis-count may be much reduced.

Inasmuch as suction is applied to the suction port in a timed relationship to the rotor rotation, suction may equally be applied to the further port in a timed relationship to the rotor rotation. Preferably, suction is applied to said ports by means of a foot which is urged to bear on a surface of the rotor and which foot is connected to a low-pressure source, the foot having a port which comes into and out of registration with respective transfer ports on the rotor as the rotor rotates, the transfer ports being respectively connected to the suction port and further port so that air is drawn through those ports at the appropriate times.

So as to minimise the likelihood of a single sheet properly picked up by air drawn through the suction port of the rotor being drawn towards the further port and so rejected from the transfer groove, it is preferred for full suction to be applied to the further port only when a sheet has been picked up by the rotor, for counting. The rotor may therefore include means sensitive to the picking-up of a sheet to be counted, and to control the air drawn through the further port dependent upon said means. In a preferred embodiment, said means comprises a venting arrangement for the further port, which venting arrangement is closed by a sheet properly picked up by the rotor so as thereafter to allow full suction to be applied to the further port. Until a sheet has properly been picked up, the venting arrangement serves to reduce the volume of air which is drawn through the further port and so reduce the likelihood of a single sheet being drawn to the further port rather than the suction port.

The further port is preferably defined in an insert for the rotor, mounted to overlie a ramp surface formed in the rotor so as to form in conjunction with that ramp surface a part of the transfer groove. A gap may be defined between a radial edge of the insert and the main part of the rotor, through which gap mis-fed sheets may be rejected out of the transfer groove, for counting subsequently.

According to a second aspect of this invention, there is provided a method of rejecting one of two sheets drawn simultaneously towards the transfer groove of a rotor of the kind described during rotation of the rotor to perform a counting operation, in which method air is drawn through a further port on the side of the transfer groove opposed to said suction port so as to draw a second, mis-fed sheet away from a first, properly-fed sheet, and then to guide said second sheet through a reject groove back to the stack, for counting on a subsequent count cycle.

By way of example only, counting apparatus having a rotor of the kind described and including a further port and reject slot in accordance with the present invention, will now be described in detail, reference being made to the accompanying drawings, in which.

Figure 1:
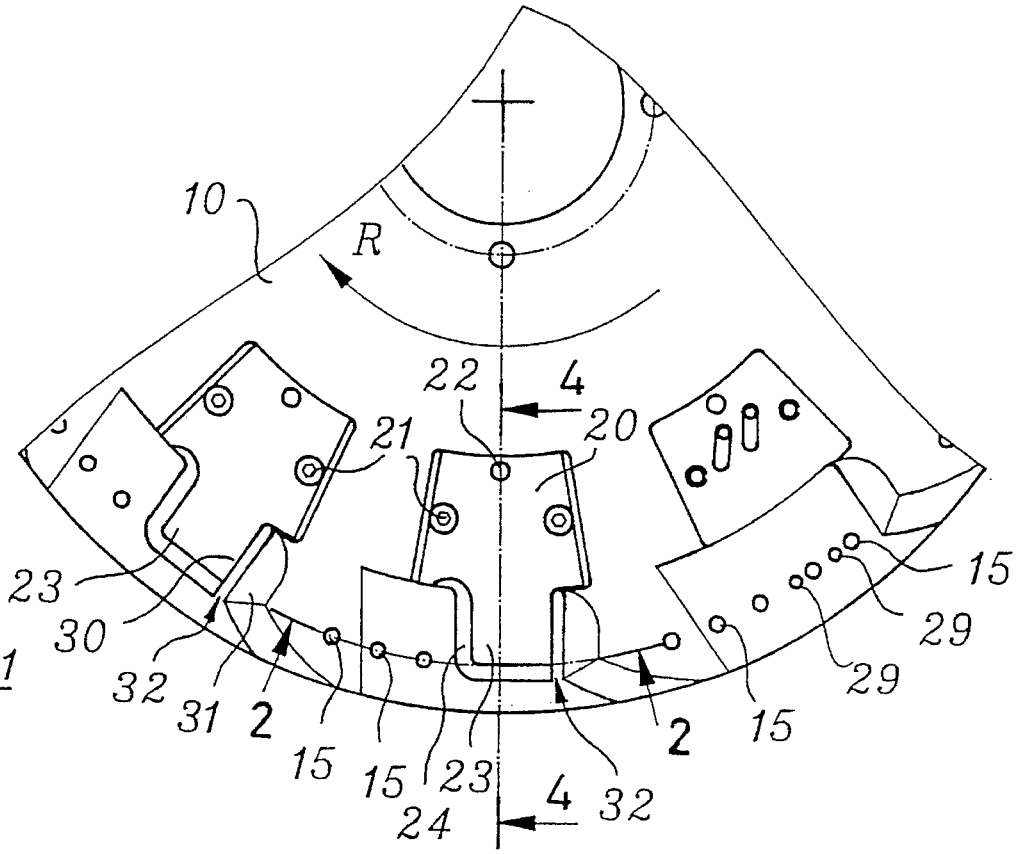
FIG. 1 is a plan view of a sector of the counting rotor of the apparatus, with certain parts (including one finger) removed for clarity.

The counting apparatus described below is intended to count the number of sheets, for example of paper, in a stack utilising a rotor of the kind described which is rotated and simultaneously moved along the height of the stack, as sheets are transferred from one side of the rotor to the other. Such apparatus is, in principle, well-known and will not be described in detail here. Control arrangements for advancement of a carriage supporting the rotor are described in our copending International Patent Application filed in our name contemporaneously herewith, and claiming priority from 93GB-12613.4

A rotor of the kind described may take the form of a disc 10 having upper and lower surfaces 11 and 12, though in practice the disc may conveniently be employed with the upper surface 11 lowermost, and at the commencement of a counting sequence, engaging the top of a stack of paper assembled on a counting table. The periphery of the disc has a plurality—and typically ten—generally helical transfer grooves 13 extending from the upper surface 11 to the lower surface 12 of the disc. Each groove has a sufficient depth in the radial direction to allow the edge portion—and usually a corner portion—of a sheet to be counted to be located in and held by the groove, to ensure reliable transfer of the sheet from one side of the disc to the other.

Each groove 13 has a ramp portion 14 adjacent the disc upper surface 11, which ramp portion is formed with a plurality of suction ports 15. Each suction port communicates through internal passageways 16 in the disc to a respective transfer port 17 on the lower surface of the disc. The transfer ports 17 all lie on a common pitch circle and a vacuum foot 18 is urged to engage the lower surface of the disc to wipe over the transfer ports, on rotation of the disc. The vacuum foot 18 includes at least two ports 19 connected to a low-pressure source so that air is drawn through the suction ports 15 in turn, as the disc rotates over the foot 18. The timing of the suction may be controlled by adjusting the position of the foot relative to the disc, and also by altering the port configuration in the foot.

The rotor shown in the drawings has been modified in accordance with this invention, to reduce the likelihood of a mis-count by an erroneous feeding of two sheets at the same time into the transfer groove of the rotor, by allowing rejection of one of those two sheets out of the groove. The initial part of the transfer groove is defined by the ramp portion 14 of the rotor and an opposed finger 20 attached to the disc by screws 21 and a locating dowel 22. Each finger has a radially-projecting portion 23 having a bevelled leading edge 24, having regard to the normal sense of disc rotation R. The underside of the finger 20 (that is, the surface of the finger facing the ramp portion 14) is formed with a pair of reject ports 25 connected back by a passageway 26 through the disc to a further transfer port 27 in the lower surface 12 of the disc, adjacent the transfer ports 17. These further transfer ports 27 also sweep over the vacuum foot 18 and come into and out of communication with further ports 28 formed in the foot and connected back to a low-pressure source.

Figure 4:
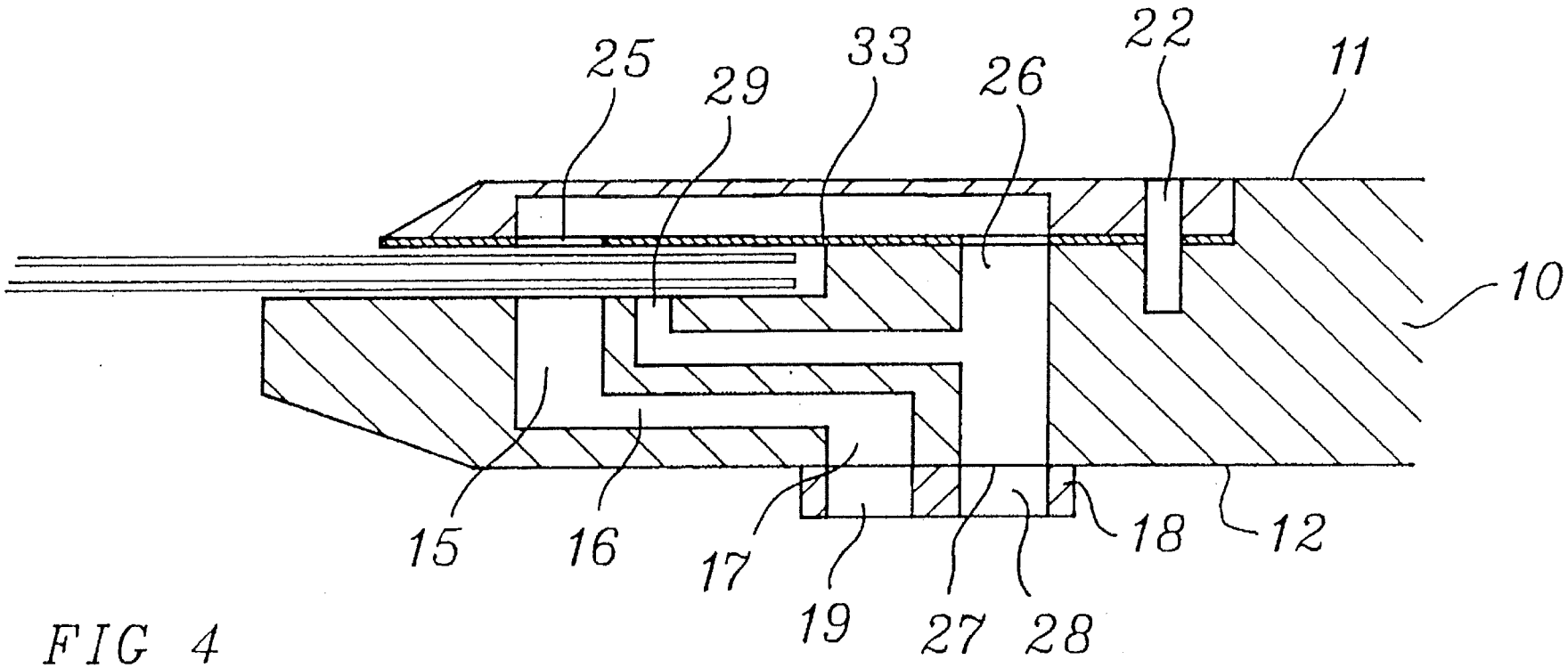
FIG. 4 is a radial cross-section taken on line B—B marked on FIG. 1, but of a slightly modified port arrangement as compared to FIG. 1.

The passageway 26 is provided with a venting port 29, formed in the ramp portion 14 of the disc, adjacent the suction ports 15. As shown in FIG. 1, the venting ports 29 are arranged on the same pitch circle as the suction ports 15, though for the sake of clarity in FIG. 4, a venting port 29 is shown aligned radially with a suction port 15.

Figure 2:
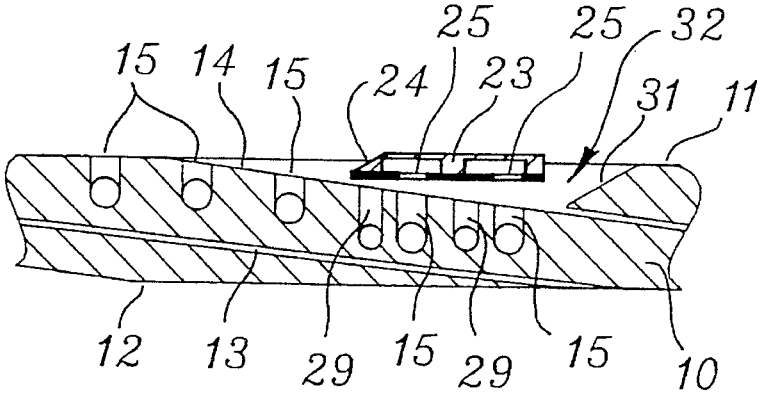
FIG. 2 is a development on line A—A marked on FIG. 1.
Figure 3:
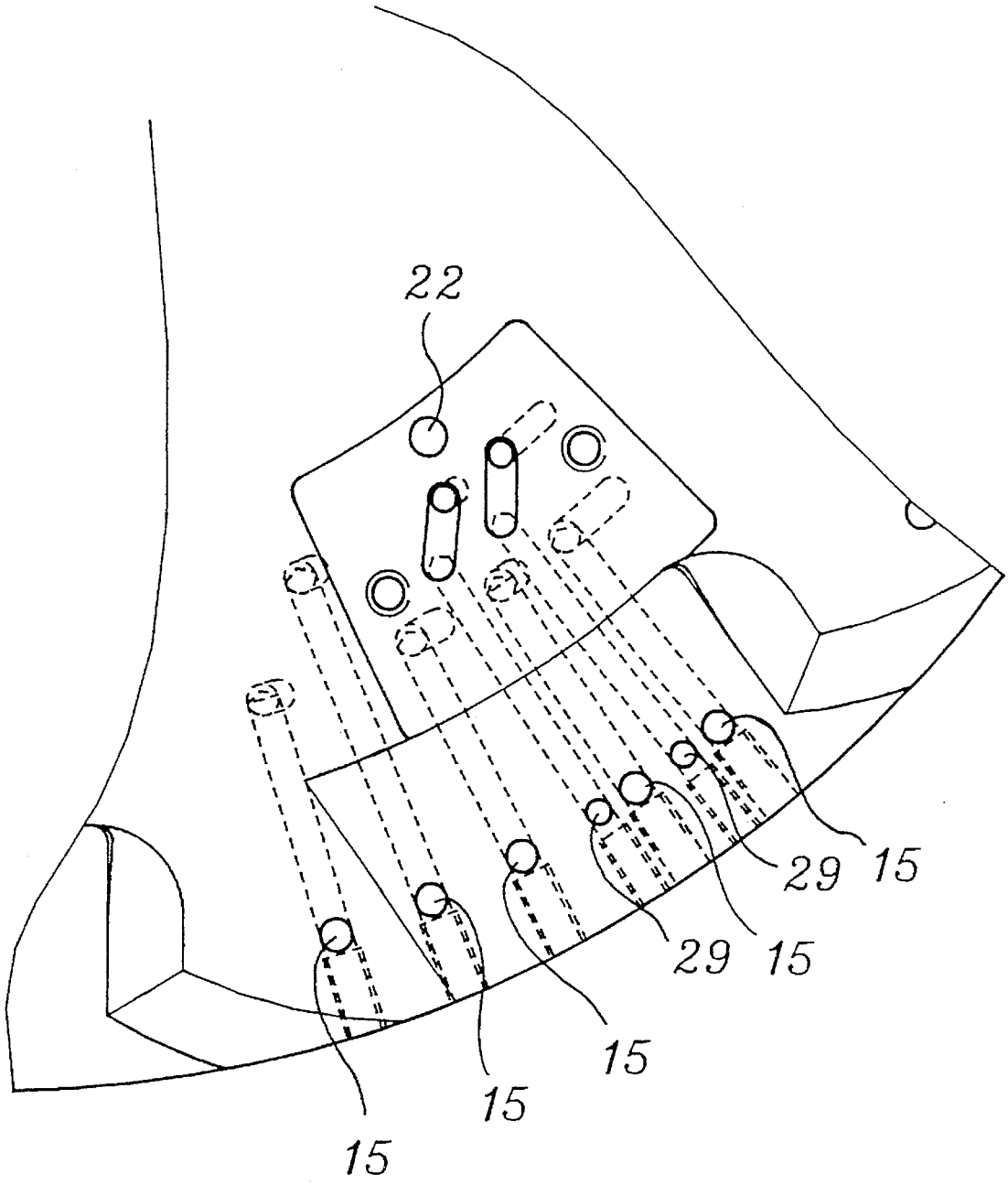
FIG. 3 is a detailed view on an enlarged scale of the porting arrangement of the rotor of FIG. 1.

The trailing edge 30 of the projecting portion 23 of each finger is spaced from edge 31 of the disc above the respective transfer groove 13, which edge 31 is bevelled as shown in FIG. 2. In this way, a reject slot 32 out of the groove 13 is formed for a mis-fed sheet, separated by suction through ports 25 in the finger.

In view of the relatively small axial thickness of each finger, it is convenient to manufacture the finger by machining slots appropriately disposed in the surface of the finger which is to face the ramp portion 14, that surface then being covered by a shim plate 33 having the ports 25 formed therein at the required locations. The shim plate 33 may be made of stainless steel, so as to minimise wear, in use.

A gasket may be disposed between the shim plate 33 and the rotor, to improve the seal between the finger and the rotor. Moreover, by selecting the gasket thickness, the gap between the leading edge of the finger and the rotor may be adjusted to an appropriate value.

In a new British Patent Application filed in our name contemporaneously herewith, but not claiming any priority, we have described and claimed a preferred form of foot arrangement which may be used with a rotor as described above. Other foot arrangements may equally be used, such as that described in 93GB-12614.2. The other parts required to construct a complete counting apparatus form no part of the present invention and since those parts will be well-understood by those skilled in the art, they will not be described in detail here.

In use, a stack of sheets to be counted is assembled on a counting table (not shown) and the disc 10 is moved to contact the upper surface 11 with the end sheet of the stack. Suction is applied to the vacuum foot 18 and rotation of the disc in direction R is commenced. The foot 18 is appropriately positioned so that suction is applied successively to the suction ports 15 to draw the top sheet of a stack to the ramp portion 14, so picking up the edge portion of that sheet and guiding it into the associated transfer groove 13. As the sheet is transferred from one side of the disc to the other, the sheet is counted by appropriate means such as an optical sensor disposed to sense the presence of a sheet part-way through its transfer along a groove 13.

If two sheets are picked-up erroneously at the same time, the second, mis-fed sheet will be drawn to the projecting portion 23 of the finger 20, by the air drawn through the reject ports 25. Prior to a properly-fed sheet covering the venting port 29, only a relatively small volume of air is drawn through the reject ports 25, so minimising the likelihood of a properly fed sheet being lifted to the underside of the finger. However, as soon as the venting port 29 has been covered by a properly fed sheet, the volume of air drawn through the reject ports 25 will rise and enable a second sheet (if there is one) to be lifted away from the properly fed sheet. On continued rotation of the disc, such a lifted second sheet will engage the bevelled edge 31 of the disc, which edge will guide that second sheet through the slot 32 and back on to the upper surface 11 of the disc, ready for counting by the next ramp portion. Meanwhile, the properly fed sheet will continue to move along the transfer groove 13, to be counted and transferred to the lower surface of the disc.

The counting of the properly-fed sheets, and perhaps also of any mis-fed sheets returned to the stack along slot 32, may be counted by monitoring the pressures prevailing in the passageways in the rotor. The pressure monitoring may be performed by one or more suitable transducers mounted on the vacuum foot, which connect to the passageways upon rotation of the rotor.

We claim:

1. A rotor for counting the number of sheets in a stack by engaging an edge region of the stack and rotating the rotor to separate an edge portion of each sheet in turn from the stack and to transfer the separated edge portion through a transfer groove to the other side of the rotor, there being at least one suction port in the rotor and through which air is drawn in a timed relationship to rotor rotation to assist the separation from the stack of the next sheet edge portion to be counted, wherein the rotor is provided with at least one further port through which air is drawn during rotation of the rotor which further port is arranged on the opposite side of the transfer groove to said suction port, whereby should two adjacent sheet edge portions be simultaneously separated together from the stack and be lifted by said suction port, suction through the further port will lift the edge portion of the second sheet away from the sheet to be counted, to guide said second sheet edge portion away from the transfer groove for counting on a subsequent count cycle.

2. A rotor as claimed in claim 1, wherein means are provided to apply suction to the further port in a timed relationship to the rotor rotation.

3. A rotor as claimed in claim 2, wherein suction is applied to said ports by means of a foot which is urged to bear on a surface of the rotor and which foot is connected to a low-pressure source, the foot having a port which comes into and out of registration with respective transfer ports on the rotor as the rotor rotates, the transfer ports being respectively connected to the suction port and further port.

4. A rotor as claimed in claim 1, wherein there is means sensitive to the picking-up of a sheet to be counted, air drawn through the further port being controlled dependent upon said means.

5. A rotor as claimed in claim 4, wherein said sensitive means comprises a venting arrangement for the further port, which venting arrangement is closed by a sheet properly picked up by the rotor so as thereafter to allow full suction to be applied to the further port.

6. A rotor as claimed in claim 5, wherein the further port is defined in an insert for the rotor, mounted to overlie a ramp surface formed in the rotor so as to form in conjunction therewith a part of the transfer groove.

7. A rotor as claimed in claim 5, wherein sheet counting is performed by monitoring the pressure prevailing in the passageways in the rotor.

8. A rotor as claimed in claim 1, wherein the further port is defined in an insert for the rotor, mounted to overlie a ramp surface formed in the rotor so as to form in conjunction therewith a part of the transfer groove.

9. A rotor as claimed in claim 8, wherein a gap is defined between a radial edge of the insert and the main part of the rotor, through which gap mis-fed sheets may be rejected out of the transfer groove.

10. A rotor as claimed in claim 8, wherein the insert includes a passageway from the further port which communicates with a passageway in the rotor whereby suction may be applied to the further port in a timed relationship to the rotor rotation.

11. A rotor as claimed in claim 1, wherein sheet counting is performed by monitoring the pressure prevailing in the passageways in the rotor.

12. A method of rejecting one of two sheets drawn simultaneously towards the transfer groove of a rotor for counting the number of sheets in a stack by engaging an edge region of the stack and rotating the rotor to separate an edge portion of each sheet in turn from the stack and to transfer the separated edge portion through a transfer groove to the other side of the rotor, there being at least one suction port in the rotor and through which air is drawn in a timed relationship to rotor rotation to assist the separation from the stack of the next sheet edge portion to be counted, in which method air is drawn through a further port on the side of the transfer groove opposed to said suction port so as to draw a second, mis-fed sheet away from a first, properly-fed sheet, and then to guide said second sheet through a reject groove back to the stack, for counting on a subsequent count cycle.

13. A method as claimed in claim 12, in which air is drawn through said further port in a timed relationship to rotor rotation.

14. A method as claimed in claim 12, in which the counting of the sheets is performed by sensing the pressures prevailing in internal passageways in the rotor and leading to the ports therein.

15. A method as claimed in claim 13, in which the counting of the sheets is performed by sensing the pressures prevailing in internal passageways in the rotor and leading to the ports therein.

* * * * *